United States Patent [19]

Eber et al.

[11] 4,389,171

[45] Jun. 21, 1983

[54] GAS COMPRESSOR OF THE SCROLL TYPE HAVING REDUCED STARTING TORQUE

[75] Inventors: David H. Eber; John R. Sauls, both of La Crosse, Wis.

[73] Assignee: The Trane Company, La Crosse, Wis.

[21] Appl. No.: 225,211

[22] Filed: Jan. 15, 1981

[51] Int. Cl.[3] ..... F04C 18/02; F04C 29/08

[52] U.S. Cl. ..... 418/15; 418/55

[58] Field of Search ..... 418/15, 55; 417/302, 417/310, 504

[56] References Cited

U.S. PATENT DOCUMENTS

| | | | |
|---|---|---|---|
| 2,394,166 | 2/1946 | Gibson | 418/15 |
| 2,519,913 | 8/1950 | Lysholm | 418/15 |
| 3,677,664 | 7/1972 | Wycliffe et al. | 418/15 |
| 3,809,510 | 5/1974 | Gregerson et al. | 418/15 |
| 4,065,279 | 12/1977 | McCullough | 418/55 |

FOREIGN PATENT DOCUMENTS

| | | | |
|---|---|---|---|
| 333307 | 2/1921 | Fed. Rep. of Germany | 418/15 |

*Primary Examiner*—John J. Vrablik

*Attorney, Agent, or Firm*—Carl M. Lewis; Peter D. Ferguson; Ronald M. Anderson

[57] ABSTRACT

A gas compressor of the scroll type is disclosed wherein means are provided for reducing its degree of compression as it starts from a standing start in order to reduce the initial starting torque required. To this end, passage means are provided which extend through the end plate means of the compressor from a location in communication with the closed moving volumes defined between the wrap elements to a second location in communication with working gas normally at discharge pressure during operation of the compressor. Valve means are associated with the passage means for permitting flow therethrough when the pressure within the closed moving volumes exceeds the discharge pressure at said second location as the compressor starts from a standing start, and for blocking flow therethrough during operation of the compressor when discharge pressure normally exceeds the pressure in the closed moving volumes. In the preferred embodiment, the valve means comprise pressure responsive valve means operative to permit flow through the passage means when the pressure within the closed moving volumes exceeds the discharge pressure at the second location, and to prevent flow therethrough when the discharge pressure at the second location exceeds that within the closed moving volume. Preferably, the passage means comprise first and second individual passages, each having its own associated valve means.

8 Claims, 8 Drawing Figures

FIG. 4(a)
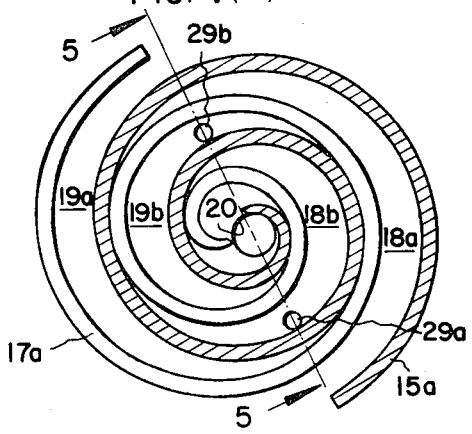
FIG. 4(b)
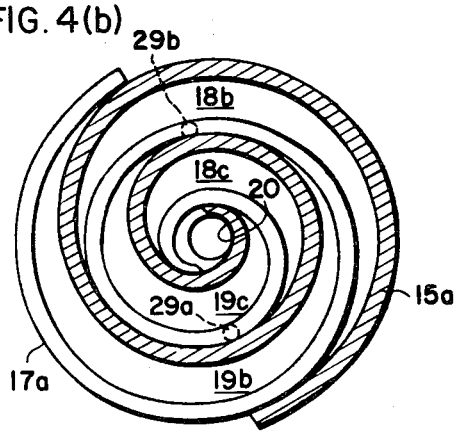
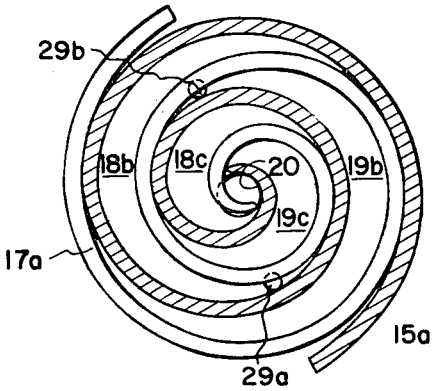
FIG. 4(c)
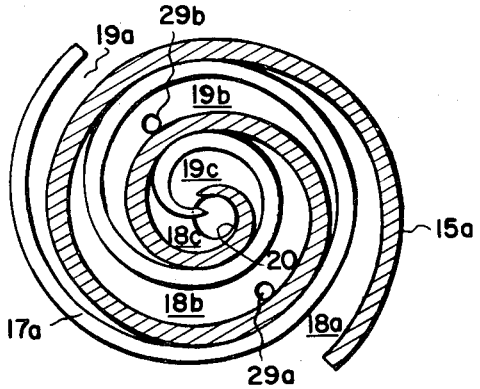
FIG. 4(d)
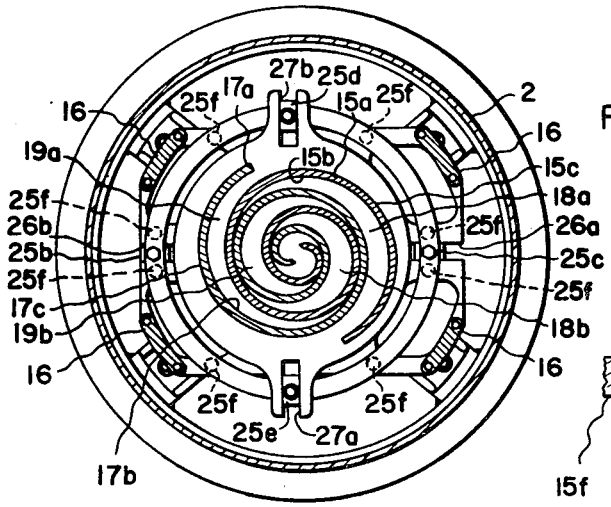
FIG. 3
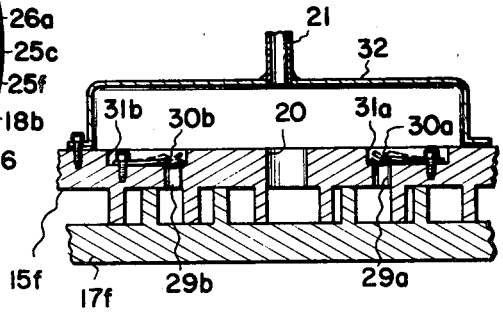
FIG. 5

GAS COMPRESSOR OF THE SCROLL TYPE HAVING REDUCED STARTING TORQUE

DESCRIPTION

1. Technical Field

The present invention is directed generally to the field of gas compressors and, specifically, relates to an improvement in a gas compressor of the scroll type, addressing the problem of reducing the starting torque requirements as the compressor is started from a standing start.

2. Background Art

In the field of positive displacement fluid apparatus, there exists a class or category generally referred to as scroll-type fluid apparatus which are characterized by the provision of wrap elements defining flank surfaces of generally spiroidal configuration about respective axes, which wrap elements lie in intermeshing, angularly offset relationship with their axes generally parallel such that relative orbital motion between the wrap elements results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus have utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between wrap elements originate at a radially outer portion thereof and progress inwardly while their volume is reduced, resulting in compression of the working gas which is then discharged at a radially inner portion of the wrap elements. Liquid pumps function in a similar fashion with the wrap elements configured such that no appreciable reduction in volume occurs as the volumes progress radially inwardly, while scroll-type expansion engines receive a relatively high pressure working fluid at the radially inner portion of their wrap elements, which then progresses radially outwardly, moving the volumes which increase in volume, with the resulting expansion of the working fluid producing mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset, parallel, axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially complaint" type, while the latter may be referred to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially complaint type drive mechanism, while U.S. Pat. No. 4,082,484 is illustrative of the fixed-crank type.

U.S. Pat. No. 3,924,977 discloses a gas compressor of the scroll type including a radially compliant, swing-link type drive means, illustrated in FIG. 19, which includes spring means for permitting start-up of the compressor without wrap-to-wrap contact of the scroll members. As discussed at column 13, lines 45–63, this arrangement permits the compressor to start in an unloaded condition.

Disclosure of the Invention

In accordance with the present invention, a gas compressor of the positive displacement scroll type is provided including first and second wrap elements defining respective flank surfaces of generally spiroidal configuration about their respective axes, and extending between first and second axial tip portions, said wrap elements being disposed in intermeshing, angularly offset relationship with their axes generally parallel. End plate means are provided in overlying, substantially sealing relationship to the axial tip portions of the wrap elements. Drive means effect relative orbital motion between the wrap elements such that moving lines of coaction between their respective flank surfaces define between the end plate means at least a first, and in the preferred embodiment, first and second, moving volumes which originate at a radially outer portion of the wrap elements and progress radially inwardly, said volumes being bounded initially by a single, leading moving line of coaction, then by leading and trailing lines of coaction so as to define a closed moving volume which is progressively reduced in volume as it moves radially inward, and finally by a single trailing line of coaction. Port means are provided for admitting a working gas at suction pressure to the wrap elements and for discharging compressed gas therefrom.

In order to reduce the degree of compression of the gas compressor as it starts from a standing start, so as to reduce the initial starting torque required, means are provided which include passage means extending through the end plate means from a location in communication with the aforesaid closed moving volumes, as they progress radially inwardly, to a second location in communication with working gas normally at discharge pressure during operation of the compressor. Valve means associated with the passage means permit flow therethrough when the pressure within the closed moving volumes exceeds that at the second locations as the compressor starts from a standing start, and block flow therethrough during normal operation of the compressor.

In the preferred embodiment, the passage means comprise first and second passages, one of which is in communication with the aforesaid first closed moving volume, the other being in communication with the second closed moving volume, each said passage being provided with its own valve means.

The gas compressor itself is preferably disposed within a hermetic shell to which working gas is admitted at suction pressure, and a discharge manifold is provided in generally overlying, sealed relationship to the end plate means of the compressor and encloses the passage means, discharge port means and valve means.

Preferably, the first and second passages extend through the end plate means at locations in communication with the respective first and second closed moving volumes at least from the time they are formed by their trailing moving lines of coaction, and until they have progressed radially inwardly to predetermined positions, each of said passages having a dimension in the radial direction which is less than or equal to the thickness of the wrap elements.

The valve means themselves preferably take the form of pressure responsive valve means which respond to the pressure within said closed moving volumes and to the discharge pressure at said second location, the valve means being operative to permit flow through the passage means when the pressure within the closed moving volumes exceeds the discharge pressure at the second location, and to prevent flow therethrough when the discharge pressure at said second location exceeds that within the closed moving volumes. Conveniently, the valve means comprise a valve element disposed in the passage means having a first surface exposed to the pressure in the associated closed moving volume, and a second surface exposed to the pressure at said second location.

Accordingly, it is an object of the present invention to provide a gas compressor of the scroll type having means for reducing its degree of compression as it starts from a standing start, in order to reduce the initial starting torque required, by permitting flow through passage means extending from its closed moving volumes to a location normally at discharge pressure during operation of the compressor, as it starts from a standing start.

It is a related object of the invention to provide such a gas compressor wherein the means for reducing its degree of compression are relatively simple in structure and operation, and low cost to manufacture.

Yet a further object of the invention is to provide such a gas compressor wherein the means for reducing its degree of compression at start-up do not materially affect its operation under normal operation conditions.

These and further objects of the invention will become apparent upon a consideration of the detailed description thereof which follows, and by reference to the accompanying drawings.

BRIEF DESCRIPTION OF THE DRAWINGS

FIG. 3 is a cross-section view taken along line 3—3 of FIG. 1.

FIG. 4(*a*) to 4(*d*) are a series of cross-section views taken along line 4—4 of FIG. 1, illustrating the wrap elements at 90° intervals of orbital motion.

FIG. 5 is a cross-section view taken along line 5—5 of FIG. 4.

BEST MODE FOR CARRYING OUT THE INVENTION

Figure 1:
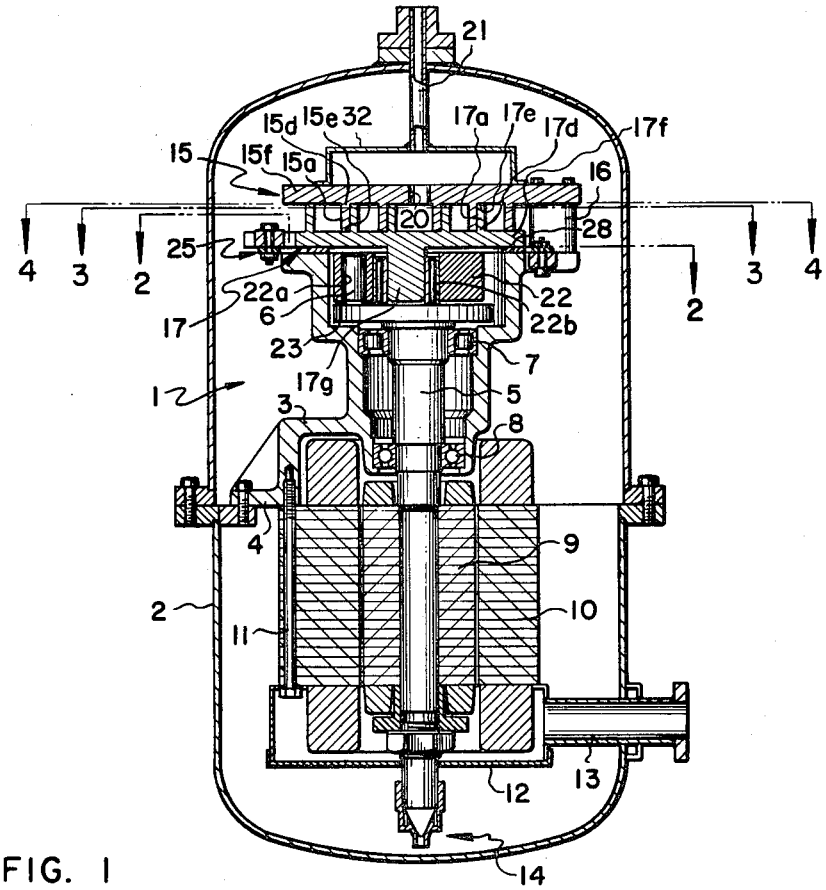
FIG. 1 is a vertical cross-section view taken along line 1—1 of FIG. 2.

Turning to FIG. 1, fluid apparatus of the positive displacement scroll type are illustrated in the form of a gas compressor indicated generally by reference numeral 1, and disposed within a hermetic casing or shell 2. A crankcase housing 3 includes a plurality of supporting legs 4 which are suitably affixed to the inner periphery of shell 2 so as to support the compressor therein.

Crankshaft means are rotatably supported within housing 3 and include a shaft 5 rotatable on a shaft axis and crank means 6 in the form of a crank pin or stub shaft affixed thereto and radially offset therefrom along a crank axis. In the embodiment illustrated in FIG. 1, shaft 5 is supported by an upper roller bearing assembly 7 and a lower ball bearing assembly 8, which bearings also serve to support any axial loads imposed upon shaft 5 due to the shoulders machined on shaft 5 and housing 3, as shown.

An electric drive motor includes a rotor 9 affixed to the lower end of shaft 5 and a stator 10 fastened to housing 3 by a plurality of bolts 11. Surrounding the lower end of stator 10 is a shroud 12 for receiving gas to be compressed from inlet conduit 13 and directing same over the drive motor for cooling purposes.

The lowermost end of shaft 5 includes a centrifugal oil pump, indicated generally by reference numeral 14, which pumps oil from a sump in the lower portion of shell 2, via one or more axial passages in shaft 5, to the various components of the compressor requiring lubrication. Since the particulars of the lubrication system do not form a part of the present invention, nor is an understanding thereof critical to the invention, no detailed explanation thereof is believed warranted. Reference may be had to U.S. Pat. No. 4,064,279 for an example of this type lubrication system.

Affixed to the upper portion of housing 3 is a fixed, or second, scroll member indicated generally at 15 and comprising a second wrap element 15*a* which, as best seen in FIG. 3, defines respectively inner and outer flank surfaces 15*b* and 15*c* of generally spiroidal configuration about a second axis and extending between a first axial tip portion 15*d* and a second axial tip portion 15*e*. Scroll member 15 further includes end plate means in overlying, substantially sealing relationship to axial tip portion 15*d* and, in the embodiment illustrated, comprise an end plate 15*f* sealingly affixed to axial tip portion 15*d*. Scroll member 15, including wrap element 15*a* and end plate 15*f*, may be machined from a single casting or block of material; or, in the alternative, wrap element 15*a* may be formed separately and then suitably attached to end plate 15*f*. By reference to FIGS. 1 and 2, it can be seen that end plate 15*f* is attached to housing 3 by four column members 16 spaced about its periphery.

An orbiting, or first scroll member indicated generally at 17 includes a first wrap element 17*a* which, as best seen in FIG. 3, defines respective inner and outer flank surfaces 17*b* and 17*c* of generally spiroidal configuration about a first axis and extending between a first axial tip portion 17*d* and a second axial tip portion 17*e*. Scroll member 17 also includes end plate means in overlying, substantially sealing relationship to axial tip portion 17*d* and, in the embodiment illustrated, comprise a first end plate 17*f* sealingly affixed to axial tip portion 17*d*. Scroll member 17 may be fabricated using those techniques outlined with respect to scroll member 15.

From FIGS. 1 and 3, it can be seen that first and second wrap elements 17*a* and 15*a*, respectively, are disposed in intermeshing, angularly offset relationship with their axes generally parallel, and such that second axial tip portions 17*e* and 15*e* extend to positions in substantial sealing relationship with end plates 15*f* and 17*f*, respectively. Although not illustrated for the sake of clarity, axial tip portions 17*e* and 15*e* may advantageously be provided with tip seals in order to improve compressor performance by reducing leakage. A variety of such tip seals are disclosed in U.S. Pat. No. 3,994,636.

By reference to FIG. 3, it can be seen that wrap elements 15*a* and 17*a* define a first series of moving volumes 18*a*, 18*b* between flank surfaces 15*b* and 17*c*; and a second series of moving volumes 19*a*, 19*b* between flank surfaces 17*b* and 15*c*; which volumes progress radially inwardly as wrap element 17*a* orbits with respect to wrap element 15*a* in a counterclockwise direction as viewed in FIG. 5. Volumes 18*a*, 19*a* comprise suction volumes bounded by a single, leading line of contact, while volumes 18*b*, 19*b* are bounded by both leading and trailing lines of contact and are reduced in volume as wrap element 17*a* undergoes orbital motion until the volumes are bounded by only a trailing line of contact and the compressed gas is discharged via port 20 and discharge conduit 21.

Thus, compressor 1 receives gas to be compressed from conduit 13 after it has passed over the drive motor as previously described, which gas enters volumes 18*a*, 19*a* from about the periphery of wrap elements 15, 17, constituting port means for admitting gas; and is discharged therefrom via port 20 and conduit 21.

Figure 2:
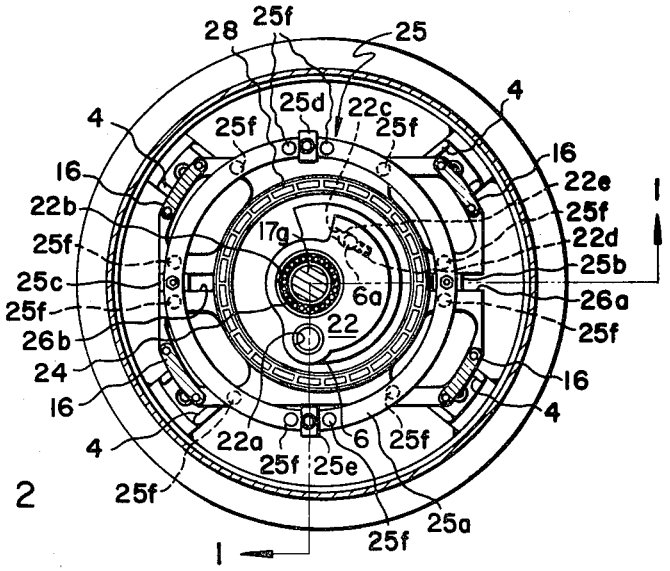
FIG. 2 is a cross-section view taken along line 2—2 of FIG. 1.

In order to impart orbiting motion to scroll member 17, radially compliant drive means are provided such that actual moving line contact is permitted between the flank surfaces of wrap elements 15*a* and 17*a*, and a sealing force acts therebetween. As shown in FIGS. 1 and 2, such means include linkage means operatively interconnecting shaft 5 and wrap element 17*a* via its attached end plate 17*f*, which linkage means comprise a linkage member 22 having a first bore 22*a* rotatably engaging stub shaft 6 of crankshaft 5; and a second bore 22*b* rotatably engaging a stub shaft 17*g* depending from end plate 17*f* along a third axis. Suitable bearing means such as journal bearing 23 between bore 22*a* and stub shaft 5; and roller bearing 24 between bore 22*b* and stub shaft 17*g* are provided as shown.

From FIG. 2 it can be seen that stub shaft 17*g* of scroll member 17 is free to undergo at least limited motion in a radial direction with respect to the axis of shaft 5 as linkage member 22 pivots or swings about the axis of stub shaft 6, thereby permitting actual line contact between the flank surfaces of wrap elements 17*a* and 15*a*. It can further be seen that, upon rotation of shaft 5, scroll member 17 will undergo orbital motion with respect to fixed scroll member 15.

Linkage member 22 further includes a bore 22*c* containing a spring 22*d*; and an axial bore 22*e* which receives a pin 6*a* affixed to shaft 5. When compressor 1 is at rest, spring 22*d* urges scroll member 17 in a radially inward direction so as to provide a clearance between the flank surfaces of wrap elements 15*a* and 17*a*, thereby reducing the initial torque required at start-up.

In order to maintain a fixed angular relationship between scroll members 15 and 17 and their associated wrap elements 15*a*, 17*a*; means are provided in the form of an Oldham coupling 25 which includes a circular ring 25*a* having a first pair of blocks 25*b*, 25*c* which are pivotally mounted thereto and slideably engage slots 26*a*, 26*b* in the upper portion of housing 3. A second pair of blocks 25*d*, 25*e* are likewise pivotally mounted to ring 25*a* and slideably engage slots 27*a*, 27*b* in end plate 17*f* (see FIG. 3). In this manner, orbiting scroll member 17 is restrained from angular displacement while permitted to undergo circular translation with a variable circular orbit radius. Ring 25*a* is further provided with a plurality of pads 25*f* which slideably engage surfaces machined on the upper portion of housing 3 and on orbiting scroll member 17. Reference may be had to U.S. Pat. No. 4,065,279 for disclosure of a similar Oldham coupling member.

Orbiting scroll member 17 is supported during its orbital motion by a thrust bearing 28 adequate to absorb the axial pressure forces to which scroll member 17 is subjected during operation. U.S. Pat. No. 4,065,279 also discloses one type of thrust bearing suitable for use in this application.

Turning next to FIGS. 4 and 5 of the drawings, it can be seen that second end plate 15*f* is provided with passage means extending therethrough and comprising a first passage 29*a* and a second passage 29*b*. As shown in FIG. 4, first passage 29*a* extends from a location in communication with first closed moving volume 18*b*, while second passage 29*b* extends from a location in communication with second closed moving volume 19*b*. From FIG. 5 it can be seen that each such passage extends to a second location in communication with discharge manifold 32 which is normally at discharge pressure during operation of the compressor, by virtue of its communication with discharge port means 20.

From an analysis of FIGS. 4(*a*) through 4(*d*), an appreciation of the function of passages 29*a* and 29*b* may be gained. Looking first at FIG. 4(*b*), it can be seen that closed moving volumes 18*b* and 19*b* have just been closed off by their trailing moving lines of coaction, but that volume 18*b* is about to be placed in communication with first passage 29*a*, while second volume 19*b* is about to be placed in communication with second passage 29*b*. This relationship continues as wrap element 17*a* undergoes orbital motion through FIGS. 4(*c*), 4(*d*), 4(*a*), and 4(*b*). At approximately the position of FIG. 4(*b*), closed moving volumes 18(*c*) and 19(*c*) are sealed off with respect to first and second passages 29*a* and 29*b*, respectively, and compression is permitted to occur therein. As should be apparent, any working gas initially within closed moving volumes 18*b* and 19*b* will be exhausted therefrom via passages 29*a* and 29*b* so long as flow therethrough is not blocked which occurs when volumes 18*a* and 19*b* are carried to the positions 18*c* and 19*c*. This has the effect of reducing the torque required of the compressor in that gas is compressed to a lesser degree.

Returning now to FIG. 5, the valve means utilized in order to control flow through the passage means comprising first passage 29*a* and second passage 29*b* will be described. End plate 15*f* of fixed scroll member 15 include elongated recesses 31*a* and 31*b* disposed in overlying relationship to respective first passage 29*a* and second passage 29b, a valve seat being defined at the point where each respective passage meets its associated recess. Disposed within each recess is an elongated valve element 30a, 30b, each of which includes a first surface overlying its associated valve seat and exposed to the pressure in its respective closed moving volume, as well as a second, upper surface exposed to the discharge pressure at the aforesaid second location comprising discharge manifold 32. Each elongated valve element is suitably affixed to end plate 15f at its end opposite the aforesaid surfaces such that the valve element may flex in response to differential pressures existing between the closed moving volumes and discharge manifold 32, as shown in dotted line in FIG. 5. To illustrate the operation of valve elements 30a, 30b, assume that the compressor is at rest and the pressures within the closed moving volumes and within discharge manifold 32 are essentially equalized. Upon start-up of the compressor, pressure within the closed moving volumes will rise rapidly, within the first two to three cycles of the orbiting scroll member, while the discharge pressure within discharge manifold 32 will not increase so rapidly. This condition will cause valve elements 30a and 30b to flex upwardly (as viewed in FIG. 5) in order to permit working gas from the closed moving volumes to be exhausted therefrom. As the compressor comes up to speed, however, and reaches a normal operating condition, the pressure within discharge manifold 32 will exceed that within the closed moving volumes, it being noted that the pressure within closed moving volumes 18b, 19b will always be less than the discharge pressure at discharge port means 20, and valve elements 30a and 30b will return to their closed positions blocking flow through their respective passage means.

It should thus be apparent that applicants' invention is operative to reduce the degree of compression of the compressor at start-up and thereby reduce the starting torque required to be generated by the drive motor. It should further be noted at this time that, although the preferred embodiment as disclosed previously includes spring 22d cooperating with linkage member 22 and pin 6a in order to reduce the initial starting torque required for the compressor, that the present invention has application either in combination with or without this type linkage member, and specifically, that the present invention would have application in compressors of the type equipped with a fixed-crank type drive mechanism discussed previously.

It may further be noted at this time that the present invention has the advantage of being relatively simple in construction and operation, and susceptible to economical manufacture. Moreover, it should be specifically pointed out that the volume occupied by first and second passages 29a and 29b is at least partially minimized due to the provision of recesses 31a and 31b occupied by valve elements 30a and 30b. This is a significant consideration in compressor design in that this volume represents a theoretical loss within the compression cycle in that compressed gas trapped therein at the maximum pressure reached within volumes 18b or 19b will be permitted to re-expand when it is subsequently reopened to the chamber at a lower pressure.

It should be further noted at this time that, although the preferred embodiment is illustrated utilizing flapper-type pressure responsive valve means, other types might be substituted therefor without departing from the scope of the invention. Moreover, the precise size and/or location of the passage means may be susceptible to variation so long as the desired level of torque reduction is accomplished.

Other variations in the invention without departing from its scope might include different scroll orbiting schemes, such as orbiting both scroll members in opposite directions; or the location of the drive means about the periphery of the scroll members rather at their center. Similarly, the wrap elements could be of trapezoidal cross section as shown, for example, in U.S. Pat. No. 1,041,721. It is further possible that wrap elements might be provided on opposite sides of a common end plate, as shown in U.S. Pat. No. 3,011,694; or the provision of a wrap element having no end plate affixed thereto as shown in U.S. Pat. No. 1,376,291.

Accordingly, the scope of the invention is to be determined by reference to the claims which follow:

We claim:

1. A gas compressor of the positive displacement scroll type comprising a. a first wrap element defining inner and outer flank surfaces of generally spiroidal configuration about a first axis and extending between first and second axial tip portions;

b. a second wrap element defining inner and outer flank surfaces of generally spiroidal configuration about a second axis and extending between first and second axial tip portions, said first and second wrap elements being disposed in intermeshing, angularly offset relationship with their respective axes generally parallel;

c. end plate means comprising a first end plate sealingly affixed to the first axial tip portion of said first wrap element and a second end plate sealingly affixed to the first axial tip portion of said second wrap element, the second axial tip portions of said first and second wrap elements extending to a point in substantial sealing relationship to said second and first end plates respectively; further comprising means for maintaining said second wrap element and end plate in a fixed position;

d. drive means operative to drive said first wrap element and end plate in an orbital path with respect to said second wrap element and end plate such that moving line coaction between the inner facing flank surface of said first wrap element and the outer facing flank surface of said second wrap element, and between the outer facing flank surface of said first wrap element and the inner facing flank surface of said second wrap element, defines between said end plate means first and second moving volumes originating at a radially outer portion of said wrap elements and progressing radially inwardly to a radially inner portion thereof, said volumes being bounded initially by a single, leading moving line of coaction so as to define a suction volume; then by both leading and trailing lines of coaction so as to define a closed moving volume which is progressively reduced in volume as it moves radially inwardly; and finally by a single trailing line of coaction so as to define a discharge volume;

e. port means for admitting a working gas at a suction pressure to said suction volumes and for discharging compressed gas from said discharge volume, said discharge port means extending through said second end plate;

f. a discharge manifold disposed in generally overlying, sealed relationship with respect to said second end plate and in communication with said discharge port means, whereby said discharge manifold is normally at discharge pressure during operation of said compressor; and g. means for reducing the degree of compression of said gas compressor as it starts from a standing start in order to reduce the initial starting torque required comprising i. passage means comprising a first passage extending through said second end plate from a location in communication with said first closed moving volume as it progresses radially inwardly, to said discharge manifold; and a second passage extending through said second end plate from a location in communication with said second closed moving volume as it progresses radially inwardly, to said discharge manifold; each of said first and second passages having a dimension in the radial direction which is less than or equal to the thickness of said wrap elements and extending through said second end plate at a location immediately adjacent one of the flank surfaces of said second wrap element;

ii. pressure responsive valve means for permitting flow through said first and second passages when the pressure within said respective first and second moving volumes exceeds that within said discharge manifold as said compressor starts from a standing start, and for blocking flow therethrough during normal operation of said compressor, said valve means comprising first and second valve elements disposed in said respective first and second passages, said first and second valve elements having a first surface exposed to the pressure in said respective first and second closed moving volumes and a second surface exposed to the pressure within said discharge manifold; said valve elements being movable to positions permitting flow through said passages in response to a pressure within said closed moving volumes greater than that within said discharge manifold, and to positions blocking flow through said passages in response to a pressure within said discharge manifold greater than that within said closed moving volumes.

2. The gas compressor of claim 1 further comprising means for maintaining a fixed angular relationship between said first wrap element and end plate and said second wrap element and end plate.

3. The gas compressor of claim 1 wherein each of said first and second valve elements comprises an elongated, flexible member having one end thereof affixed to said second end plate and the other end thereof defining said first and second surfaces in overlying relationship to its associated passage.

4. The gas compressor of claim 1 wherein said gas compressor is disposed within a hermetic shell, and wherein working gas is admitted to said shell such that the interior thereof is at suction pressure, further comprising a discharge conduit extending from said discharge manifold through said hermetic shell.

5. The gas compressor of claim 1 wherein said first and second passages extend through said second end plate at locations in communication with said respective first and second closed moving volumes at least from the time they are formed by said trailing moving lines of coaction and until they have progressed radially inwardly to predetermined positions.

6. The gas compressor of claim 5 wherein said predetermined positions are characterized in that said first and second closed moving volumes have not yet reached the position at which they become discharge volumes bounded by only a single, trailing line of coaction.

7. The gas compressor of claim 1 wherein said first and second passages extend through said second end plate and terminate at a recess in a surface of said second end plate, said recess serving to reduce the volume which said first and second passages would otherwise occupy.

8. The gas compressor of claim 7 further comprising valve seats defined within said recesses where said first and second passages terminate.

* * * * *